US012557892B2

(12) United States Patent
Shepovalov

(10) Patent No.: US 12,557,892 B2
(45) Date of Patent: Feb. 24, 2026

(54) NAIL CLIPPER ASSEMBLY

(71) Applicant: Dmitrii Shepovalov, Brooklyn, NY (US)

(72) Inventor: Dmitrii Shepovalov, Brooklyn, NY (US)

( * ) Notice: Subject to any disclaimer, the term of this patent is extended or adjusted under 35 U.S.C. 154(b) by 101 days.

(21) Appl. No.: 18/670,187

(22) Filed: May 21, 2024

(65) Prior Publication Data

US 2024/0398090 A1 Dec. 5, 2024

Related U.S. Application Data

(60) Provisional application No. 63/470,201, filed on Jun. 1, 2023.

(51) Int. Cl.
*A45D 29/02* (2006.01)

(52) U.S. Cl.
CPC ..... *A45D 29/023* (2013.01)

(58) Field of Classification Search
CPC ..... A45D 29/02; A45D 29/023; A01K 17/00; A01K 13/00
USPC ..... D28/60
See application file for complete search history.

(56) References Cited

U.S. PATENT DOCUMENTS 2,753,626 A * 7/1956 Bowers ..... A45D 29/02 30/28
2,887,773 A * 5/1959 Killen ..... A45D 29/023 30/28
3,031,754 A * 5/1962 Pocoski ..... A45D 29/023 30/28
3,943,948 A * 3/1976 Sartore ..... A45D 29/02 30/28
4,219,929 A * 9/1980 Min ..... A45D 29/023 30/28
D347,296 S * 5/1994 Adelman ..... D28/60
7,222,427 B1 * 5/2007 Kaidi ..... A45D 29/023 30/28
10,076,173 B1 * 9/2018 Kaidi ..... A45D 29/02
11,759,963 B1 * 9/2023 Warner ..... B25G 1/102 7/106
2006/0180169 A1 * 8/2006 Lund ..... A45D 29/02 132/73.5
2011/0061239 A1 * 3/2011 Pacio ..... A45D 29/02 30/28
2016/0286931 A1 * 10/2016 LaTorre ..... A45D 29/023
(Continued)

*Primary Examiner* — Adam J Eiseman
*Assistant Examiner* — Richard D Crosby, Jr.
(74) *Attorney, Agent, or Firm* — Lawrence G. Fridman, ESQ; FEIGIN & FRIDMAN, LLC

(57) ABSTRACT

A nail clipper assembly, including a hollow body accommodating a nail clipping mechanism which includes a pair arms, each terminating in a blade, such that a gap is formed between the blades. A button is disposed in a portal in the body and is depressible from the exterior of the hollow body. The button engaging one of the arms, and depression of the button reduces the gap between the blades. A unitarily formed front cover includes a hollow portion defining a portal which accommodates the blades, and a pair of symmetrical extensions, extending rearwardly from its sides. When the nail clipper assembly is closed, the blades are disposed within the portal and are flush with a front end of the front cover. Nail clippings generated during use of the nail clipping mechanism are collected within the hollow body portion of the front cover.

14 Claims, 11 Drawing Sheets

(56) References Cited

U.S. PATENT DOCUMENTS

| | | | | |
|---|---|---|---|---|
| 2018/0184782 | A1* | 7/2018 | Meshi-Prendi | A45D 29/023 |
| 2019/0029390 | A1* | 1/2019 | Lyttle | A45D 29/023 |
| 2019/0125057 | A1* | 5/2019 | Gittens | A45D 29/023 |

* cited by examiner

NAIL CLIPPER ASSEMBLY

REFERENCE TO RELATED APPLICATION

This application claims priority of U.S. Provisional Application Ser. No. 63/470,201 filed Jun. 1, 2023, the entire disclosure of which is hereby incorporated by reference.

FIELD AND BACKGROUND OF THE DISCLOSED TECHNOLOGY

The disclosed technology relates generally to nail clippers, and, more specifically, to a nail clipper including a housing assembly to retain nail clippings there-within until they are discarded.

Nail clippers have been known for many years. However, when people clip their nails, the clippings often fall onto surfaces around them, which is messy, unsanitary, and can cause injuries because of the sharpness of the nail clippings. As such, many people have attempted to develop nail clippers which would retain the clippings inside.

U.S. Pat. No. 1,463,733 to Turner is directed toward a desk organizer to provide a convenient means for receiving, in classified order, various papers and letters such as ordinarily gather on the desk. The organizer thereof is particularly adapted to hold a plurality of papers without losing its shape and without assuming a bulky appearance. The organizer includes a base, to which is connected a block having a slanted surface. A plurality of leaves are secured to the block. However, the organizer of Turner still takes up significant desk space, as seen in FIG. 1 thereof.

U.S. Pat. No. 5,546,658 to MacLeod et al is directed toward a nail clipping and collecting device for use with a conventional nail clipper. A conventional nail clipper is removably positioned within a base and within a handle of the device which are removably hingedly connected together. The base is configured for receiving, storing, and emptying nail clippings.

U.S. Pat. No. 5,983,498 to Lieberman et al is directed toward a device for clipping nails and retaining the clippings. The nail clipper includes a lower arm member defining an opening and a cutting edge at an end thereof. The nail clipper further has an upper arm member springingly attached to the lower arm member, the upper arm member further defining a cutting edge in corresponding placement to the cutting edge of the lower arm member. The nail clipper further includes a receptacle for retaining nail clippings, an actuating handle, and a retaining pin connecting the lower arm member, the upper arm member, the receptacle, and the actuating handle.

U.S. Pat. No. 10,517,368 to Lyttle et al is directed toward a nail clipping and collecting device which includes a housing and a clipper. The housing defines an interior volume and includes first and second actuation mechanisms. A door distal to the clipping edges is adapted for removal of the clippings.

U.S. Patent Application Publication No. 2011/0061239 to Pacio is directed to a nail clipper assembly including a base having a pair of opposite nail clipping blades spring biased away from one another. A lever capable of actuating the clipping blades is rotationally attached to the base. A housing substantially enclosing the base and lever includes an arm aperture through which the clipping blades may at least partially extend. A manually actuable button coupled to the housing engages the lever to move the clipping blades toward one another so that a user may cut a nail with the nail clipper assembly.

There is thus a need in the art for a nail clipping assembly which ensures that the nail clippings are collected in a receptacle until a user wishes to remove them, that the nail clippings are easy to remove, and that the assembly does not require a specific nail clipper structure.

SUMMARY OF THE DISCLOSED TECHNOLOGY

The disclosed technology relates generally to nail clippers, and, more specifically, to a nail clipper including a housing assembly to retain nail clippings there-within until they are discarded.

According to an embodiment of the disclosed technology, there is provided a nail clipper assembly, including a body defining a hollow and including at least one surface defining a portal, the hollow accommodating a nail clipping mechanism. The nail clipping mechanism includes a pair arms, each terminating in a blade, such that a gap is formed between the blades. A button is disposed in the portal of the body and is depressible relative thereto from the exterior of the hollow body, the button engaging one of the arms such that depression of the button results in reducing the gap between the blades of the nail clipping mechanism.

The nail clipper assembly further includes a unitarily formed front cover, including a hollow body portion, including a front portal adapted to accommodate the blades of the nail clipping mechanism, and a pair of symmetrical extensions, extending rearwardly from sides of the hollow body portion.

In a closed operative state of the nail clipper assembly, the extensions of the front cover extend along sides of the body, such that the blades are disposed within the portal and are flush with a front end of the front cover. In an open operative state of the nail clipper assembly, the blades are accessible to a user. Nail clippings generated during use of the nail clipping mechanism are collected within the hollow body portion of the front cover, and are stored therein until opening of the nail clipper assembly.

In some embodiments, the sides of the body each include an engagement element, and the extensions of the front cover each include a corresponding engagement element, such that in the closed operative state of the nail clipper assembly, the engagement elements on the sides of the body engage the corresponding engagement elements of the front cover.

In some embodiments, the engagement elements and the corresponding engagement elements include magnets.

In some embodiments, the body includes an upper surface defining a first portal and a lower surface defining a second portal. The nail clipper assembly has the button disposed in the first portal, and further includes a second button disposed in the second portal and depressible relative thereto. The button engages one of the arms of the nail clipping mechanism and the second button engages the other arm of the nail clipping mechanism, such that depression of the button and the second button results in reducing the gap between the blades of the nail clipping mechanism.

In some embodiments, the button engages an end of the arm.

In some embodiments, the nail clipping mechanism further includes a biasing member, adapted, when pressure is removed from the button, to bias the arms back to a resting position thereby to increase the gap between the arms.

In some embodiments, the body further includes internal upper and lower slanted surfaces disposed within the body, the arms of the nail clipping mechanism being constrained between the internal upper and lower slanted surfaces.

In some embodiments, a fulcrum about which the arms pivot when pressure is applied to the button, extends from side to side through the body.

In some embodiments, a portion of each of side of the body is cut away to form a recess for receiving the extensions of the front cover, such that, in the closed operative state of the nail clipper assembly, the extensions of the front cover are flush with the sides of the body.

According to another embodiment of the disclosed technology, there is provided a nail clipper assembly, including a hollow upper body portion including a front surface terminating in a front edge, an upper surface defining a portal, and side surfaces and a rear surface all terminating in a first edge.

The nail clipper assembly further includes a hollow lower body portion including a front surface terminating in a first blade, a lower surface, and side surfaces and a rear surface all terminating in a second edge.

The nail clipper assembly further includes a button, disposed within the portal and depressible relative thereto from an exterior of the upper body portion.

The nail clipper assembly further includes an arm, anchored to the lower surface and terminating in a second blade. The arm is resiliently disposed in engagement with the front edge of the upper body portion, such that the second blade is disposed adjacent the first blade, and a gap is formed between the first and second blades.

The nail clipper assembly further includes a lever including an end engaging the button and a pushing portion engaging the arm.

Depression of the button causes the lever to apply pressure to the arm, pushing the arm toward the lower body portion, thereby reducing the gap between the blades. In a closed operative state of the nail clipper assembly, the upper body portion is disposed above the lower body portion, and nail clippings generated during use of the nail clipping mechanism are collected within the hollow lower body portion, and are stored therein until opening of the nail clipper assembly.

In some embodiments, the upper surface of the upper body portion an engagement element. The lower body portion includes a non-hollow block extending into the hollow of the upper body portion, and terminating in a corresponding engagement element. In the closed operative state of the nail clipper assembly, the engagement element on the upper body portion engages the corresponding engagement elements of the lower body portion.

In some embodiments, the engagement element and the corresponding engagement element include magnets.

In some embodiments, following release of pressure from the button, the lever pivots back to its resting position under the resilient force of the arm, which moves upward until it engages the front edge of the upper body portion.

DETAILED DESCRIPTION OF EMBODIMENTS OF THE DISCLOSED TECHNOLOGY

In an embodiment of the disclosed technology, a nail clipper assembly, includes a hollow body accommodating a nail clipping mechanism which includes a pair arms, each terminating in a blade, such that a gap is formed between the blades. A button is disposed in a portal in the body and is depressible from the exterior of the hollow body. The button engaging one of the arms, and depression of the button reduces the gap between the blades. A unitarily formed front cover includes a hollow portion defining a portal which accommodates the blades, and a pair of symmetrical extensions, extending rearwardly from its sides. When the nail clipper assembly is closed, the blades are disposed within the portal and are flush with a front end of the front cover. Nail clippings generated during use of the nail clipping mechanism are collected within the hollow body portion of the front cover.

Embodiments of the disclosed technology will become clearer in view of the following description of the drawings.

Figure 1A:
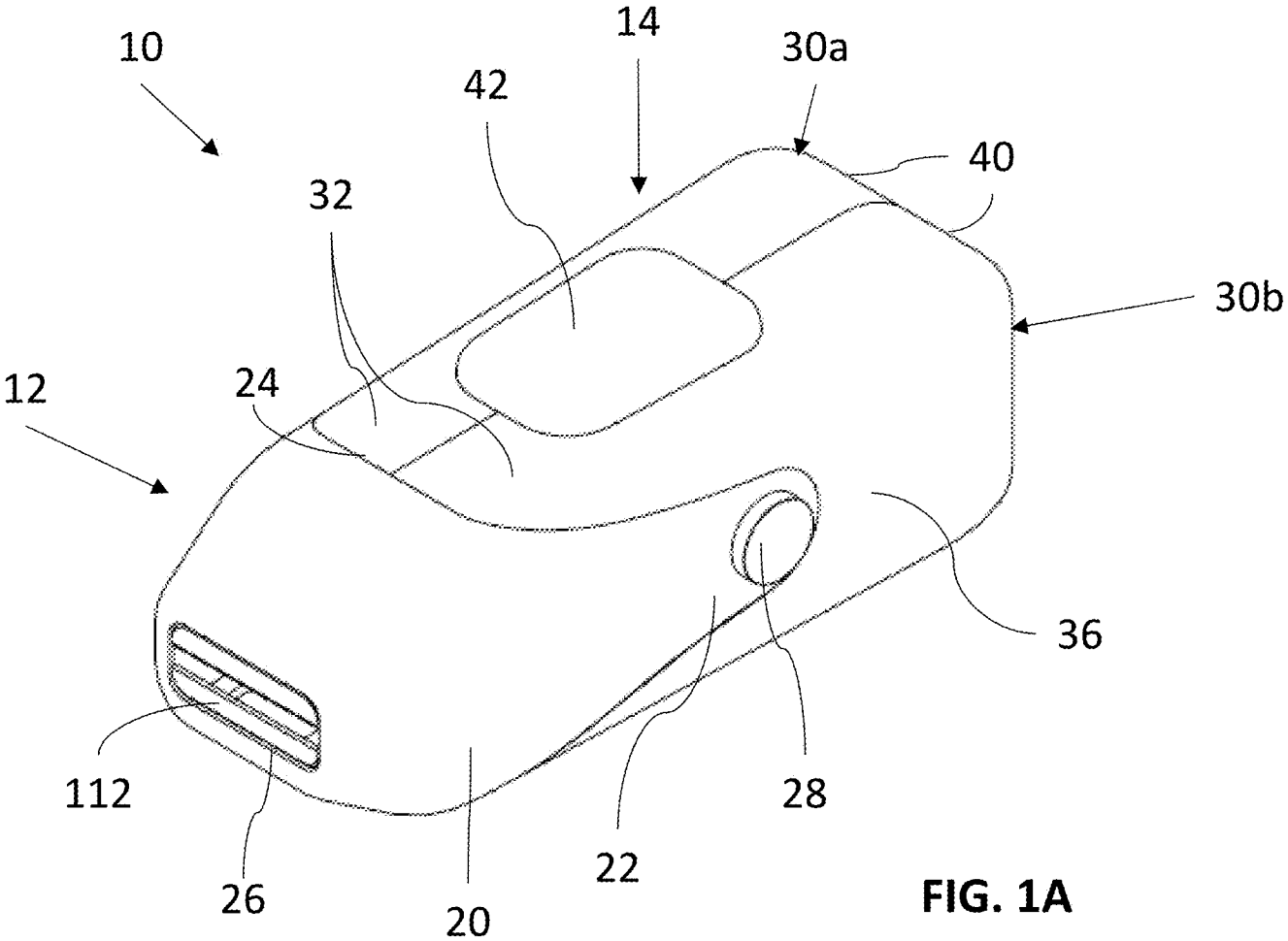
FIGS. 1A and 1B are perspective view illustrations of a nail clipper assembly according to an embodiment of the disclosed technology, in closed and open operative states, respectively.
Figure 1B:
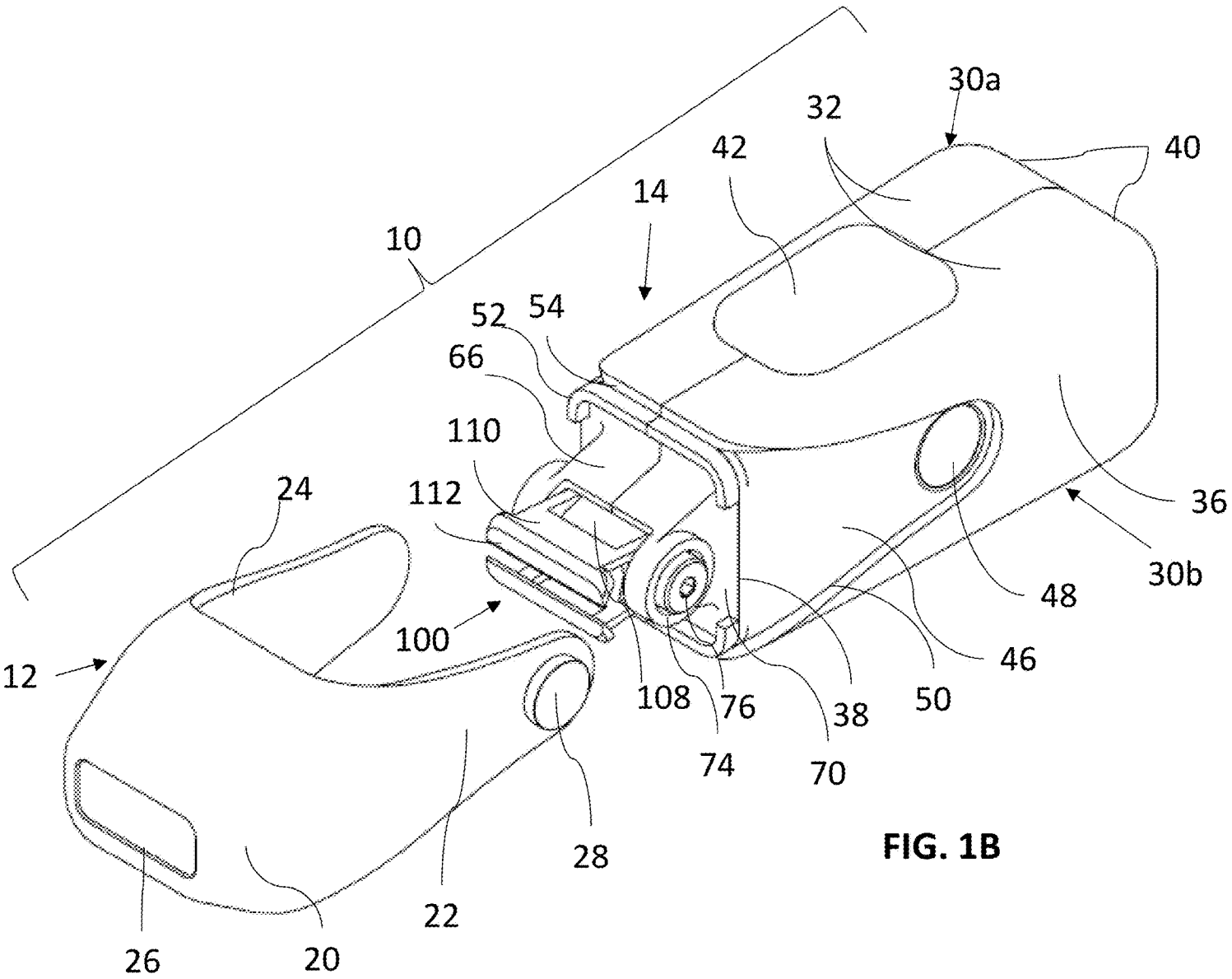
Figure 2B:
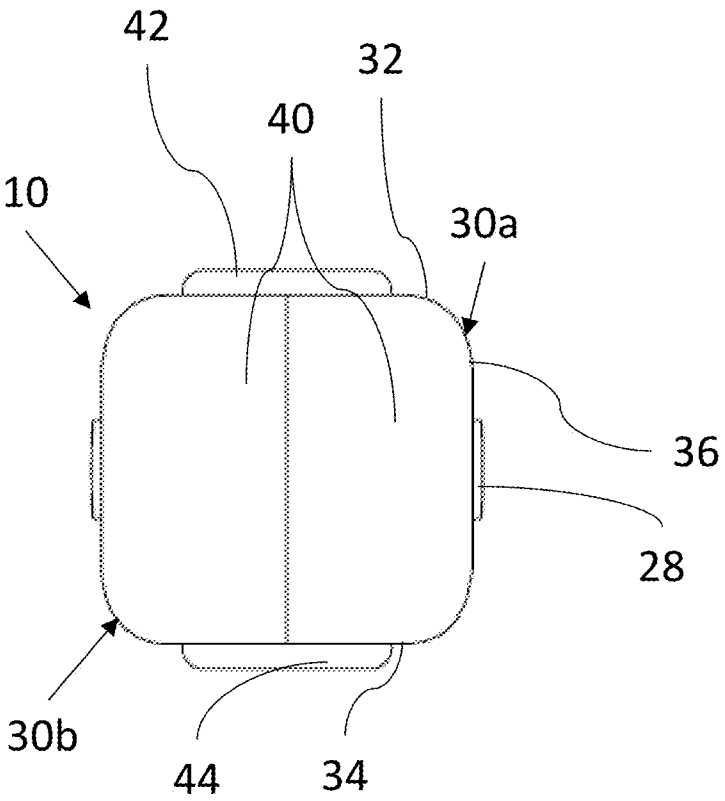
FIGS. 2A, 2B, 2C, and 2D are, respectively, a front view planar illustration, a back view planar illustration, a top view planar illustration, and a side view planar illustration of the nail clipper assembly of FIG. 1A in the closed operative state.
Figure 2A:
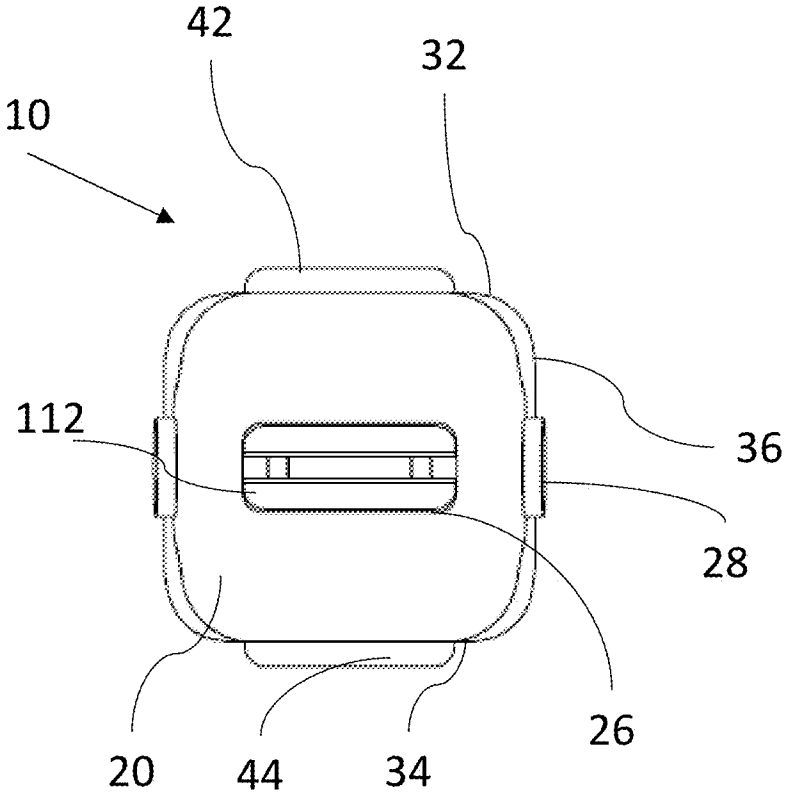
Figure 2C:
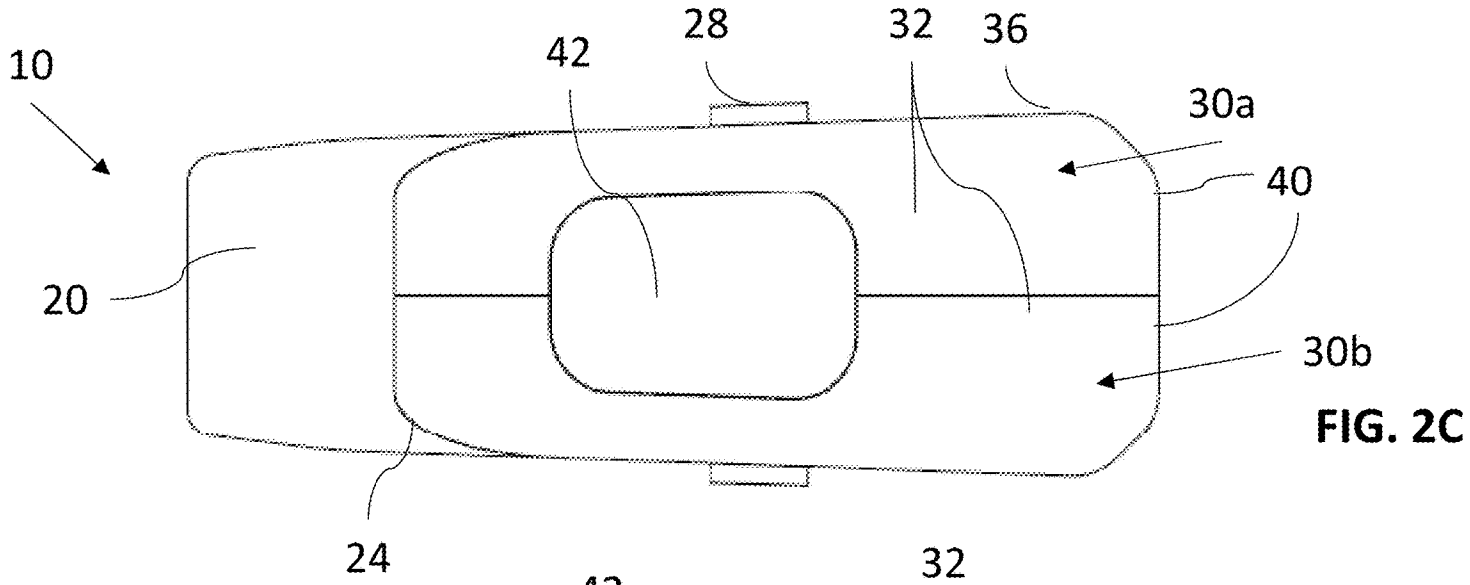
Figure 2D:
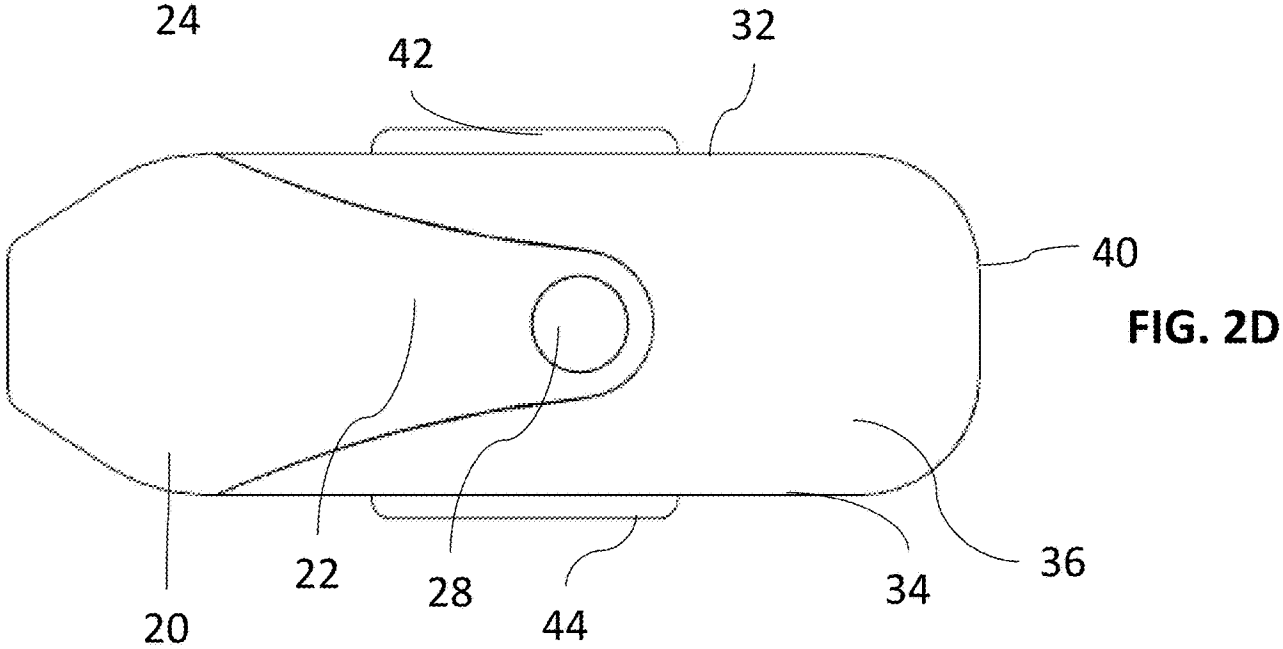

Reference is now made to FIGS. 1A and 1B, which are perspective view illustrations of a nail clipper assembly 10 according to an embodiment of the disclosed technology, in closed and open operative states, respectively, and to FIGS. 2A, 2B, 2C, and 2D, which are, respectively, a front view planar illustration, a back view planar illustration, a top view planar illustration, and a side view planar illustration of nail clipper assembly 10 in the closed operative state.

As seen, nail clipper assembly 10 includes a front cover 12 and a main body 14.

Front cover 12 includes a substantially curved, or tapered, hollow body 20, having two elongate extensions 22 extending rearwardly from sides of body 20. Extensions 22 can be substantially symmetrical to each other. A rim 24 is formed along extensions 22 and the rear edge of upper and lower surfaces of body 20. A portal 26 is formed in the front portion of front cover 12. The front cover 12 is formed with adjacent rear ends of extensions 22, each of the extensions includes an engagement element 28, for example in the form of a magnet. In some embodiments, body 20 and extensions 22 are unitarily formed of a single piece of material.

Main body 14 includes a housing formed of two longitudinal housing portions 30*a* and 30*b*, each including an upper surface 32, a lower surface 34, a side surface 36, all terminating at a front edge 38, and a back surface 40. Housing portions 30*a* and 30*b* are adapted to connect to each other along a longitudinal length thereof.

Upper surfaces 32 and lower surfaces 34 each include an indentation, adjacent the center of the longitudinal section thereof, such that the indentations of housing portions 30*a* and 30*b* together form an upper portal adapted to receive an upper button 42 and a lower portal adapted to receive a lower button 44.

Side surfaces 36 of housing portions 30*a* and 30*b* each include an elongate depression 46, which can also be identified as an area where the thickness of the side surfaces is smaller. Disposed at rear ends of depressions 46 are engagement elements 48, corresponding to engagement elements 28 of the front cover and adapted for engagement therewith. For example, engagement elements 48 may also be magnets.

Depressions 46 define a shoulder 50 therearound, and are sized and configured to accommodate extensions 22 of front cover 12. Flanges 52 extend longitudinally outwardly from front edge 38 of upper surfaces 32 and lower surfaces 34, thereby defining second shoulders 54 along the upper and lower surfaces. Shoulders 50 and 54, together, are adapted to engage rim 24 of front cover 12, such that flanges 52 are disposed within the hollow of the front cover, and extensions 22 are disposed within depressions 46. In some embodiments, when front cover 12 engages body 14, an exterior surface of extensions 22 is flush with side surfaces 36, as seen clearly in FIGS. 2A to 2D.

Figure 3:
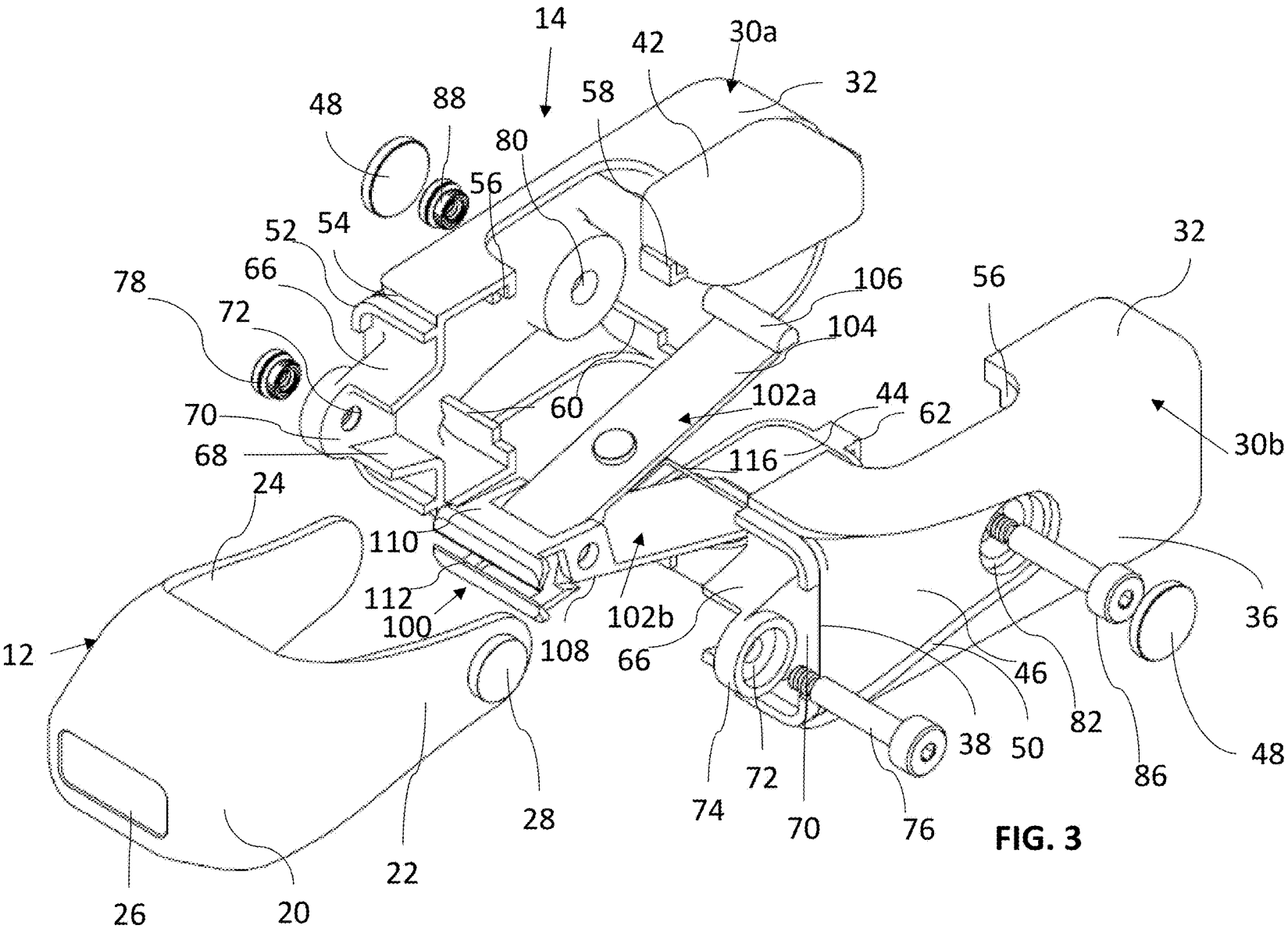
FIG. 3 is an exploded view illustration of the nail clipper assembly of FIGS. 1A to 2D.
Figure 4:
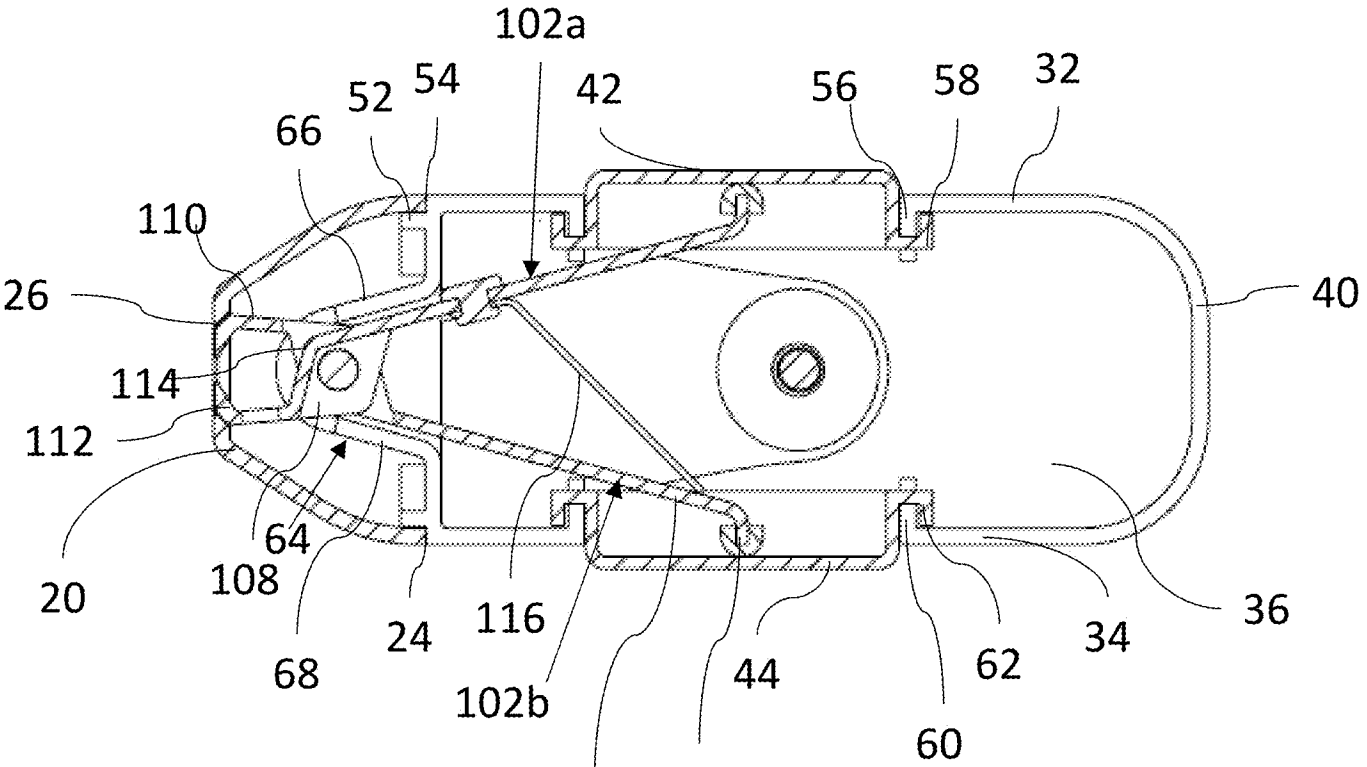
FIG. 4 is a sectional illustration of the nail clipper assembly of FIGS. 1A to 3, in the closed operative state.

Reference is now additionally made to FIG. 3, which is an exploded view illustration of nail clipper assembly 10, and to FIG. 4, which is a sectional illustration of nail clipper assembly 10, in its closed operative state.

As seen in FIG. 3, each of housing portions 30*a* and 30*b* includes flanges 56, extending downwardly from upper surfaces 32. Upper button 42 includes flanges 58, extending upwardly from the lower edge of the button and adapted to engage flanges 56. Similarly, each of housing portions 30*a* and 30*b* includes flanges 60, extending upwardly from lower surfaces 34. Lower button 44 includes flanges 62, extending downwardly from the upper edge of the button and adapted to engage flanges 60.

A front housing extension 64 (see also FIG. 4) extends forwardly from front edge 38 of each of housing portions 30*a* and 30*b*. Each front housing extension 64 includes a downwardly-slanted upper surface 66 and an upwardly-slated lower surface 68, which together are adapted to accommodate a nail clipping mechanism, as explained in further detail hereinbelow. Surfaces 66 and 68 are fixed to side surfaces 70, extending inwardly from side surfaces 36.

Side surfaces 70 each includes a bore 72 and a circular protrusion 74, the bore and circular protrusion adapted to accommodate a screw 76 and a corresponding nut 78, which hold the housing portions 30*a* and 30*b* together. Additionally, screw 76 may function as a fulcrum for the nail clipping mechanism, as explained further herein. In the closed operative state of assembly 10, front housing extensions 64 are disposed within the hollow of body 20 of front cover 12, as seen clearly in FIG. 4.

An additional bore 80 and an additional indentation 82 are defined in each depression 46, inwardly of magnets 48. Bores 80 and indentations 82 are adapted to accommodate a screw 86 and a corresponding nut 88, which hold the housing portions 30*a* and 30*b* together closer to the rear thereof. In the open operative state of assembly 10, screw 86 and nut 88 are hidden by presence of magnets 48 thereover.

A nail clipping mechanism 100 is disposed within a hollow of body 12, between body portions 30*a* and 30*b*. Nail clipping mechanism 100 includes first and second arms 102*a* and 102*b*, each including a rear-portion 104, terminating at a rear end in a protrusion 106, and at a front end in a fulcrum engaging portion 108. Each arm further includes a front-portion 110, extending forwardly from the fulcrum-engaging portion 108, and terminating in a blade portion 112. At fulcrum-engaging portion 108 each of arms 102*a* and 102*b* includes a shoulder 114 formed between the rear portion 104 and the front portion 110.

First arm 102*a* functions as the upper arm, such that rear portion 104 thereof is disposed above the rear portion 104 of second arm 102*b*. Protrusion 106 of the first arm 102*a* is disposed in engagement with upper button 42. Inversely, second arm 102*b* functions as the lower arm, with protrusion 106 thereof engaging lower button 44. Because of the existence of shoulders 114 at fulcrum engaging portions 108 of arms 102*a* and 102*b*, the blade portion 112 of first arm 102*a* is disposed beneath the blade portion 112 of second arm 102*b*.

A biasing mechanism 116, such as a leaf spring, extends from rear portion 104 of first arm 102*a* to rear portion 104 of second arm 102*b*. The biasing mechanism is adapted to facilitate reducing of the distance between arms 102*a* and 102*b* for blade portions 112 to engage each other, when pressure is applied to buttons 42 and/or 44, and resilient return of the arms to their resting positions upon release of the pressure.

Screw 76 extends through fulcrum-engaging portions 108, and functions as the fulcrum about which arms 102*a* and 102*b* pivot when pressure is applied to buttons 42 and/or 44. The fulcrum-engaging portions are disposed between surfaces 66 and 68 of front housing extension 64, thereby securing the position of the nail cutting mechanism 100 relative to housing portions 30*a* and 30*b*.

As seen clearly in FIGS. 1A and 4, in the closed operative state of assembly 10, blade portions 112 are adapted to be disposed within portal 26 of front cover 12. In some embodiments, blade portions 112 are flush with an edge of portal 26. The only portion of the nail clipping mechanism 100 that is directly accessible to the user is blade portions 112. As shown in FIG. 1B, upon removal of front cover 12 the user can discard any nail clippings captured within the front cover, and has access also to front portions 110 of the nail clipping mechanism and to front housing extension 64.

When the user removes front cover 12 from body 14, he opposes the force applied by engagement elements 28 and 48, and replaces that force when he returns the front cover to the body. For example, the user has to separate the magnets forming engagement elements 28 and 48 to open the assembly 10, and when closing the assembly, the magnets pull the front cover and body back together in the desired orientation.

Figure 5:
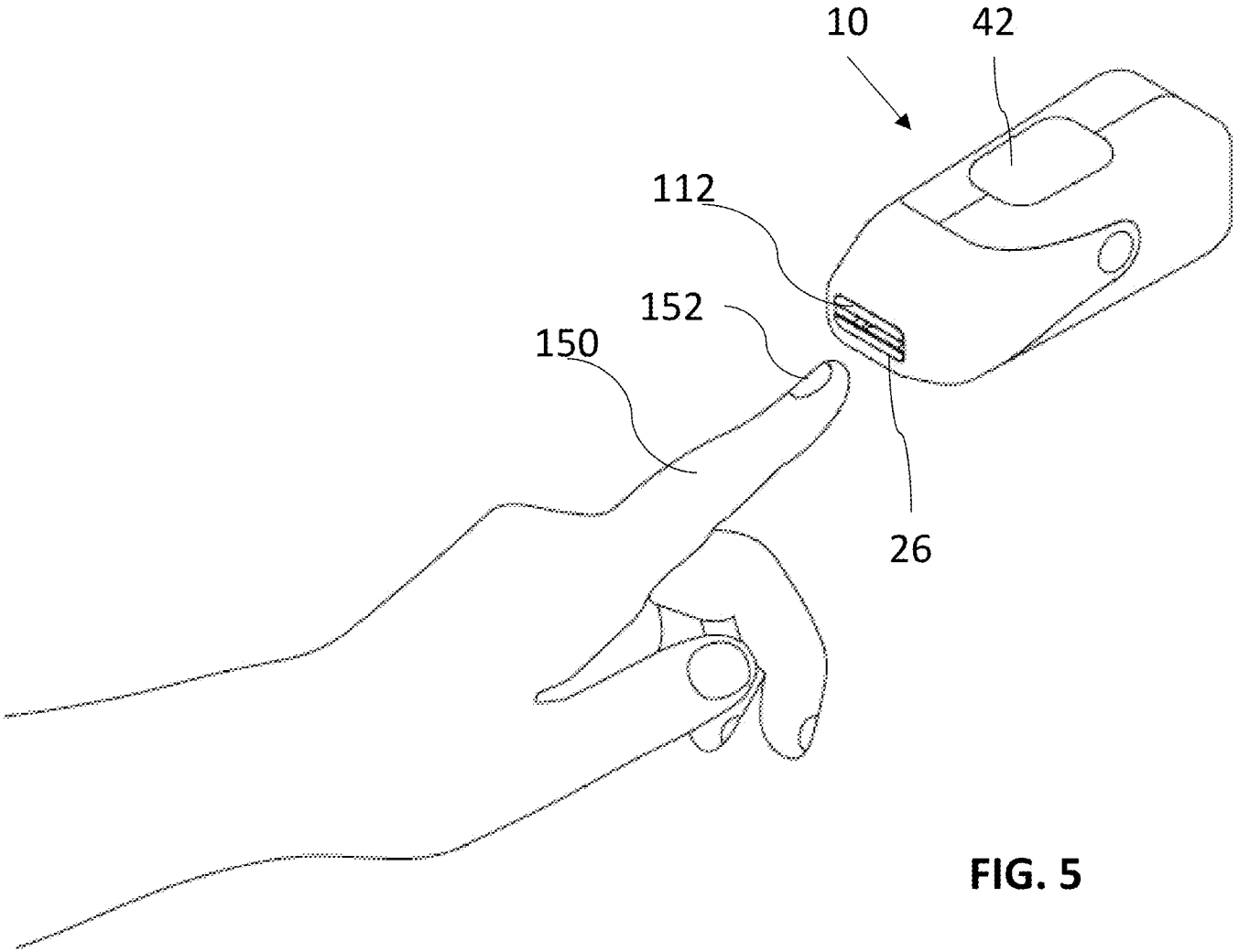
FIG. 5 is a schematic illustration of a user initiating use of the nail clipper assembly of FIGS. 1A to 4.
Figure 6:
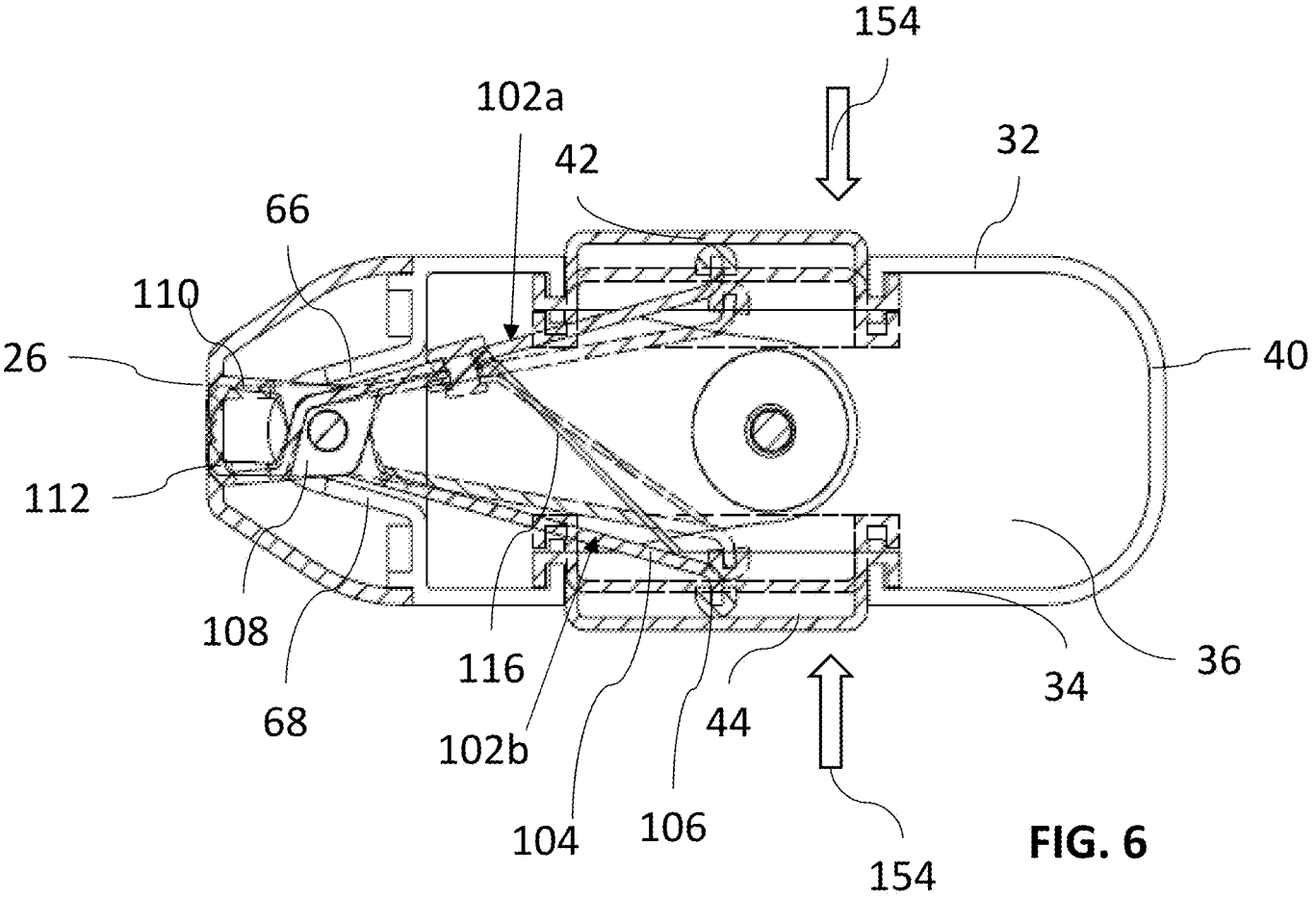
FIG. 6 is a sectional illustration of the nail clipper assembly of FIGS. 1A to 4, in the closed operative state, during operation of the nail clipper assembly by a user.

Reference is now made to FIG. 5, which is a schematic illustration of a user initiating use of the nail clipper assembly 10, and to FIG. 6, which is a sectional illustration of the nail clipper assembly 10, in the closed operative state, during operation of the nail clipper assembly by a user.

As seen in FIG. 5, the user brings their finger 150 toward assembly 10, such that their nail 152 is aligned with the gap between blade portions 112 inside portal 26. The user then inserts their nail into this gap, and holds assembly 10 with their other hand.

As best seen in at least FIG. 6, when the user applies pressure to buttons 42 and 44, in the direction of arrows 154, the pressure applied to the buttons causes first and second arms 102*a* and 102*b* to pivot relative to screw 76, which functions as the fulcrum, as shown in dashed lines. This motion causes biasing mechanism 116 to slide along second arm 102*b*, toward the rear of assembly 10. As a result of the motion of arms 102*a* and 102*b*, blade portions 112 engage one another, clipping the user's nail. The nail clipping is retained within the hollow of body 20 of front cover 12.

When the user releases the pressure from buttons 42 and 44, arms 102*a* and 102*b* return to their resting positions, shown in solid lines, under the force of biasing mechanism 116. The user can then remove their finger from being adjacent to the portal 26.

To discard the nail clippings from body 20 of front cover 12, the user removes the front cover from the main body 14 of the assembly, as shown in FIG. 1B. Subsequently, when the hollow of front cover 12 is clean, the user returns the front to its position on the main body of assembly 10, by pushing the front cover rearwardly until engagement elements 28 and 48 (e.g., magnets) engage one another.

Figure 7:
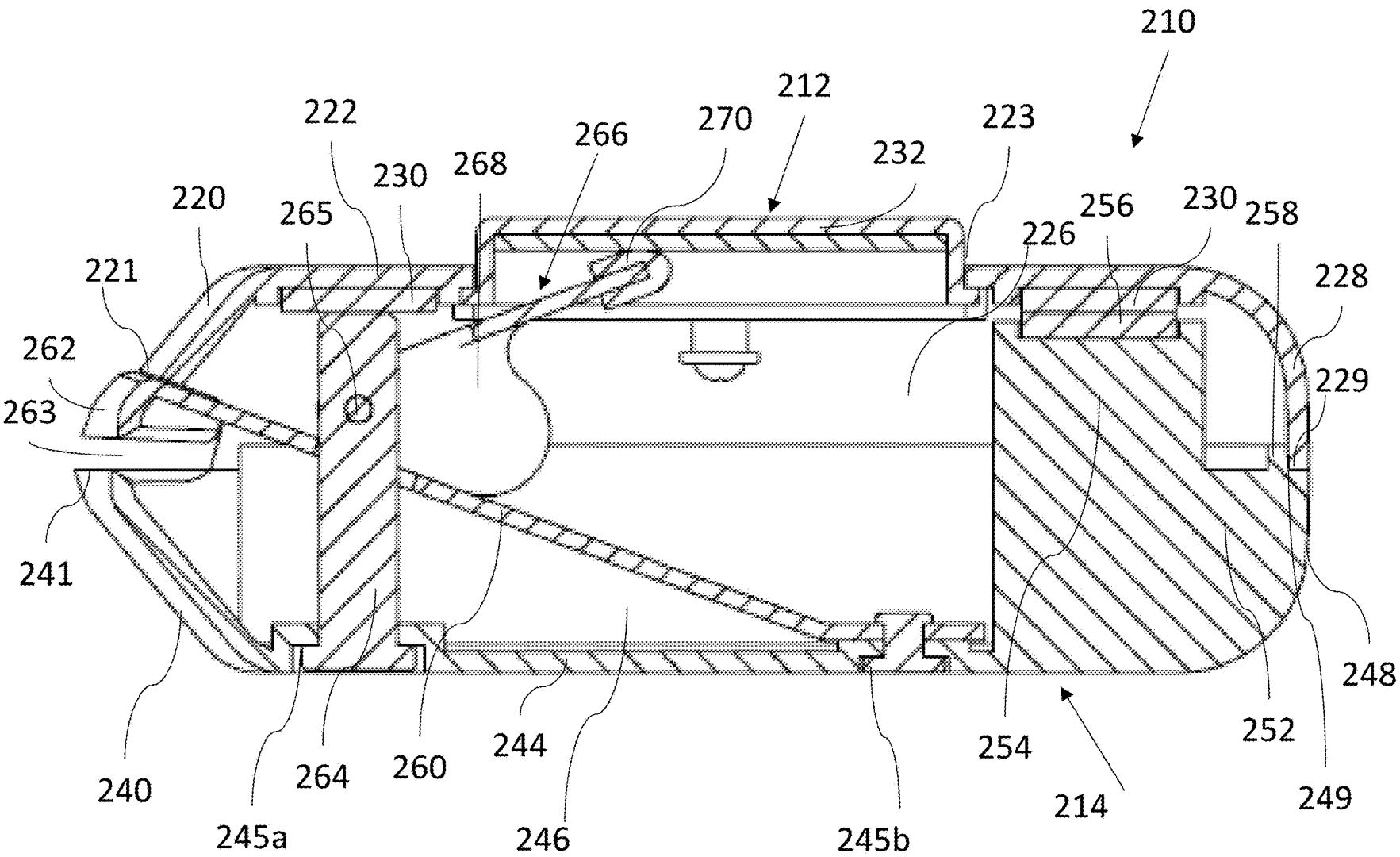
FIG. 7 is a sectional illustration of the nail clipper assembly according to another embodiment of the disclosed technology, in the closed operative state.

Reference is now made to FIG. 7, which is a sectional illustration of a nail clipper assembly 210 according to another embodiment of the disclosed technology, in the closed operative state.

As seen, nail clipper assembly 210 includes an upper body portion 212 and a lower body portion 214.

Upper body portion 212 includes a downwardly-slanted front surface 220 terminating in a front edge 221, an upper surface 222 defining a portal 223 therein, two side surfaces 226, and a rear surface 228. Side surfaces 226 and rear surface 228 all terminate in a lower edge 229.

Upper surface 222 of upper body portion has disposed therein at least one, and typically two, engagement elements 230, for example magnets. A depressible button 232 is disposed within portal 223.

Lower body portion 214 includes an upwardly-slanted front surface 240 terminating in a front blade 241, a lower surface 244 defining a first portal 245*a* and a second portal 245*b* therein, two side surfaces 246, and a rear surface 248. Side surfaces 246 and rear surface 248 all terminate in an upper edge 249, which engages edge 229 in the closed operative state of assembly 210.

At a rear portion thereof, lower body portion 214 includes a solid block having a first portion 252 substantially the height of rear surface 248, and a second portion 254 substantially higher than first portion 252, such that when upper body portion 212 is disposed above lower body portion 214, second portion 254 extends into a hollow of the upper body portion. In some embodiments, an engagement element, such as a magnet 256, is disposed at an upper end of second portion 254. When upper body portion 212 is disposed above lower body portion 214, magnet 256 is adapted to engage one of magnets 230. Extending upwardly from first portion 252 is a flange 258, which is engaged by rear surface 228 when the upper body portion 212 engages the lower body portion 214.

A nail clipping arm 260 is anchored to lower surface 244 at second portal 245*b*, and extends upwardly at a slant therefrom. A front end of nail clipping arm 260, forming a blade 262, is disposed below, and typically in engagement with, front edge 221 of upper body portion 212. Additionally, blade 262 is disposed above, and is vertically aligned with, front blade 241 of lower body portion 214, such that a gap 263 is formed between front blade 241 and blade 262.

A rod 264 extends upwardly from lower surface 244, at first portal 245*a*. Rod 264 is typically formed of metal, and as such is adapted to engage with magnet 230 disposed thereabove, when the upper body portion 212 engages the lower body portion 214. Hingedly attached to rod 264 by a hinge 265 is a lever 266, including a first portion 268 which engages nail clipping arm 260, and an end 270 which is disposed within, and engages, depressible button 232.

Figure 8:
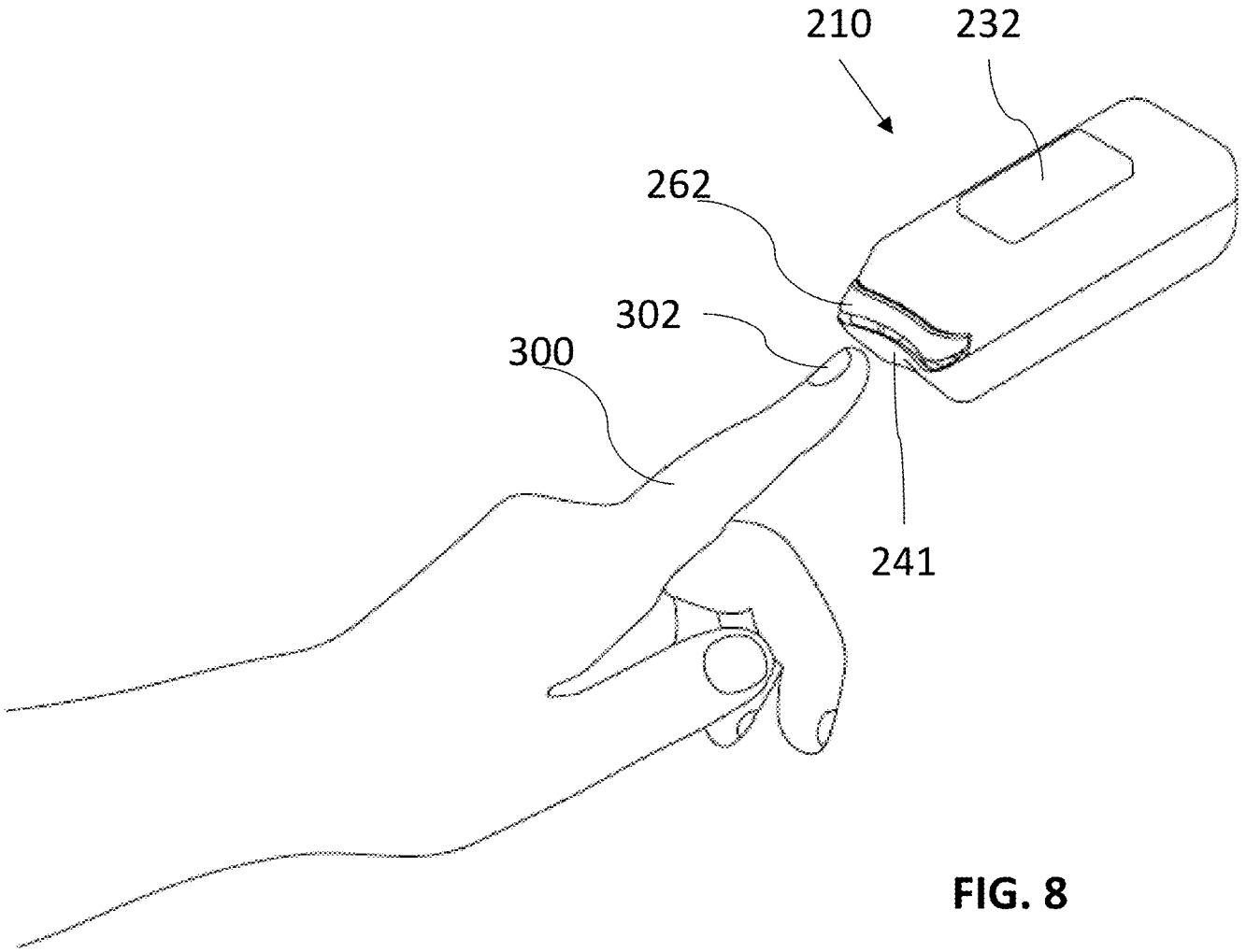
FIG. 8 is a schematic illustration of a user initiating use of the nail clipper assembly of FIG. 7.
Figure 9:
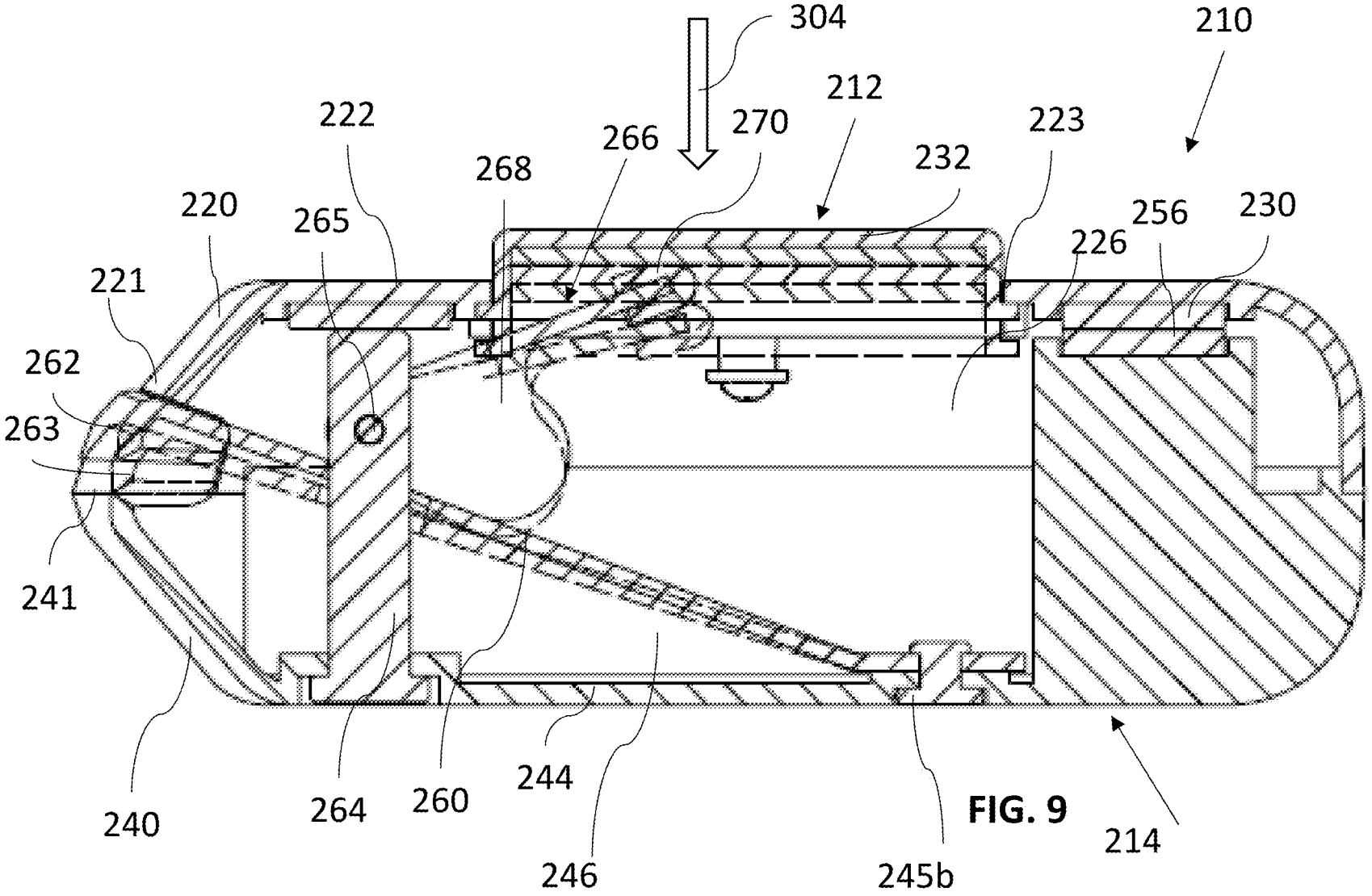
FIG. 9 is a sectional illustration of the nail clipper assembly of FIG. 7, in the closed operative state, during operation of the nail clipper assembly by a user.

Reference is now made to FIG. 8, which is a schematic illustration of a user initiating use of the nail clipper assembly 210, and to FIG. 9, which is a sectional illustration of the nail clipper assembly 210, in the closed operative state, during operation of the nail clipper assembly by a user.

As seen in FIGS. 7 and 8, the user brings their finger 300 toward assembly 210, such that their nail 302 is aligned with gap 263 between blades 241 and 262. The user then inserts their nail into this gap, and holds assembly 210 with their other hand.

As seen in FIG. 9, when the user applies pressure to button 232 in the direction of arrows 304, the button applies pressure to end 270 of lever 266, causing the lever to pivot relative to hinge 265. As a result, the first portion 268 of lever 266 applies pressure, in a downward direction, to nail clipping arm 260, causing blade 262 to advance toward blade 241 to close the gap therebetween, thereby to clip the nail disposed within the gap. The nail clipping is retained within the hollow of lower body portion 214.

When the user releases the pressure from button 232, lever 266 returns to its resting position, shown in solid lines, under the resilience of nail clipping arm 260.

To discard the nail clippings from lower body portion 214, the user removes the upper body portion 212 from the lower body portion. Subsequently, when the hollow of lower body portion 214 is clean, the user returns the front to its position on the main body of assembly 210, by sliding the upper body portion 212 over lower body portion 214 from back to front, until engagement elements 230 and 256 (e.g., magnets) engage one another.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A nail clipper assembly, comprising:

a body defining a hollow and including at least one surface defining a portal, the hollow accommodating a nail clipping mechanism, the nail clipping mechanism including a pair arms, each terminating in a blade, such that a gap is formed between the blades;

a button, disposed in the portal of the body and depressible relative thereto from the exterior of the hollow body, the button engaging one of the arms such that depression of the button results in reducing the gap between the blades of the nail clipping mechanism; and a unitarily formed front cover, including:

a hollow body portion, including a front portal adapted to accommodate the blades of the nail clipping mechanism;

a pair of symmetrical extensions, extending rearwardly from sides of the hollow body portion, wherein, in a closed operative state of the nail clipper assembly, the extensions of the front cover extend along sides of the body, such that the blades are disposed within the portal and are flush with a front end of the front cover, wherein in an open operative state of the nail clipper assembly, the blades are accessible to a user, and wherein nail clippings generated during use of the nail clipping mechanism are collected within the hollow body portion of the front cover, and are stored therein until opening of the nail clipper assembly.

2. The nail clipper assembly of claim 1, wherein the sides of the body each include an engagement element, and the extensions of the front cover each include a corresponding engagement element, such that in the closed operative state of the nail clipper assembly, the engagement elements on the sides of the body engage the corresponding engagement elements of the front cover.

3. The nail clipper assembly of claim 2, wherein the engagement elements and the corresponding engagement elements comprise magnets.

4. The nail clipper assembly of claim 1, wherein the body includes an upper surface defining a first portal and a lower surface defining a second portal, the nail clipper assembly having the button disposed in the first portal, and further including a second button disposed in the second portal and depressible relative thereto, wherein the button engages one of the arms of the nail clipping mechanism and the second button engages the other arm of the nail clipping mechanism, such that depression of the button and the second button results in reducing the gap between the blades of the nail clipping mechanism.

5. The nail clipper assembly of claim 1, wherein the button engages an end of the arm.

6. The nail clipper assembly of claim 1, wherein the nail clipping mechanism further includes a biasing member, adapted, when pressure is removed from the button, to bias the arms back to a resting position thereby to increase the gap between the arms.

7. The nail clipper assembly of claim 1, wherein the body further includes internal upper and lower slanted surfaces disposed within the body, the arms of the nail clipping mechanism being constrained between the internal upper and lower slanted surfaces.

8. The nail clipper assembly of claim 1, wherein a fulcrum about which the arms pivot when pressure is applied to the button, extends from side to side through the body.

9. The nail clipper assembly of claim 1, wherein a portion of each of side of the body is cut away to form a recess for receiving the extensions of the front cover, such that, in the closed operative state of the nail clipper assembly, the extensions of the front cover are flush with the sides of the body.

10. A nail clipper assembly, comprising:

a hollow upper body portion including:

a front surface terminating in a front edge;

an upper surface defining a portal;

side surfaces and a rear surface all terminating in a first edge;

a hollow lower body portion including:

a front surface terminating in a first blade;

a lower surface;

side surfaces and a rear surface all terminating in a second edge;

a button, disposed within the portal and depressible relative thereto from an exterior of the upper body portion;

an arm, anchored to the lower surface and terminating in a second blade, the arm being resiliently disposed in engagement with the front edge of the upper body portion, such that the second blade is disposed adjacent the first blade, and a gap is formed between the first and second blades; and a lever including an end engaging the button and a pushing portion engaging the arm, wherein depression of the button causes the lever to apply pressure to the arm, pushing the arm toward the lower body portion, thereby reducing the gap between the blades, wherein, in a closed operative state of the nail clipper assembly, the upper body portion is disposed above the lower body portion, and wherein nail clippings generated during use of the nail clipping mechanism are collected within the hollow lower body portion, and are stored therein until opening of the nail clipper assembly.

11. The nail clipper assembly of claim 10, wherein the upper surface of the upper body portion an engagement element, and the lower body portion includes a non-hollow block extending into the hollow of the upper body portion, the non-hollow block terminating in a corresponding engagement element, such that in the closed operative state of the nail clipper assembly, the engagement element on the upper body portion engages the corresponding engagement elements of the lower body portion.

12. The nail clipper assembly of claim 11, wherein the engagement element and the corresponding engagement element comprise magnets.

13. The nail clipper assembly of claim 10, wherein following release of pressure from the button, the lever pivots back to its resting position under the resilient force of the arm, which moves upward until it engages the front edge of the upper body portion.

14. The nail clipper assembly of claim 10, wherein the button engages an end of the arm.

* * * * *